US009224293B2

(12) United States Patent
Taylor

(10) Patent No.: US 9,224,293 B2
(45) Date of Patent: Dec. 29, 2015

(54) APPARATUS AND SYSTEM FOR MONITORING AND MANAGING TRAFFIC FLOW

(71) Applicant: Donald Warren Taylor, Arlington, TX (US)

(72) Inventor: Donald Warren Taylor, Arlington, TX (US)

( * ) Notice: Subject to any disclaimer, the term of this patent is extended or adjusted under 35 U.S.C. 154(b) by 0 days.

(21) Appl. No.: 14/158,797

(22) Filed: Jan. 18, 2014

(65) Prior Publication Data

US 2014/0324326 A1 Oct. 30, 2014

Related U.S. Application Data

(63) Continuation-in-part of application No. 13/815,807, filed on Mar. 16, 2013, now Pat. No. 9,070,290.

(51) Int. Cl.
*G08G 1/08* (2006.01)
*G08G 1/01* (2006.01)

(52) U.S. Cl.
CPC ..... *G08G 1/08* (2013.01); *G08G 1/0112* (2013.01); *G08G 1/0116* (2013.01); *G08G 1/0145* (2013.01)

(58) Field of Classification Search
CPC ..... G08G 1/08; G08G 1/0112; G08G 1/0116; G08G 1/087
USPC ..... 701/117, 119, 200
See application file for complete search history.

(56) References Cited

U.S. PATENT DOCUMENTS

2010/0274448 A1* 10/2010 Ueno et al. ..... 701/36
2011/0224898 A1* 9/2011 Scofield et al. ..... 701/200
2012/0035839 A1* 2/2012 Stehle et al. ..... 701/117
2013/0135118 A1* 5/2013 Ricci ..... 340/932.2

* cited by examiner

*Primary Examiner* — Yonel Beaulieu
*Assistant Examiner* — Yazan A Soofi

(57) ABSTRACT

An apparatus and system for monitoring and managing traffic flow. The system includes a plurality of remote sensor devices arranged in a plurality of vehicles, a plurality of remote communication hub devices operatively arranged along one or more roadways and in communication with the plurality of remote sensor devices, a central server, a network interface in communication with the central server and the plurality of remote communication hub devices over a network, and a shared database in communication with the central server. The central server is configured to receive traffic data from the plurality of remote sensor devices over the network, update traffic data in the shared database, periodically calculate an optimal traffic flow for one or more of vehicles traveling along the one or more roadways based on the updated traffic data, and transmit timing adjustments over the network to one or more traffic light intersections based on the optimal traffic flow calculations. The network interface is configured to send and receive traffic data. The traffic data includes vehicle location information and network traffic congestion information.

3 Claims, 8 Drawing Sheets

APPARATUS AND SYSTEM FOR MONITORING AND MANAGING TRAFFIC FLOW

CROSS REFERENCE TO RELATED APPLICATIONS

The present application is a continuation-in-part of and claims priority to U.S. patent application Ser. No. 13/815,807, entitled "Apparatus and System for Monitoring and Managing Traffic Flow," filed in the U.S. Patent and Trademark Office on Mar. 15, 2013, having at least one common inventor as the present document and hereby incorporated by reference.

BACKGROUND OF THE INVENTION

1. Field of the Invention

The present invention is generally related to transportation, and more particularly to an apparatus and system for monitoring and managing traffic flow.

2. Discussion of the Background

With ever increasing road traffic levels there is a particular need for the monitoring and management of traffic congestion, fuel consumption, environmental concerns from C02, safety related concerns, traffic flow and idle time. Existing systems generally depend on direct visual observations produced by infrared receivers for emergency vehicles that are not reactive enough if at all, video image vehicle detection system (VIVDS) that need to be humanly monitored and are inconsistent with detections due to having an engineer manually draw and adjust the detection zones repetitively, and loop detectors that are fairly expensive and have a high failure rate with limited capabilities. Such techniques can only provide extremely limited management if any at all for vehicles and are too imprecise for more sophisticated management of traffic flow and there associated variables to maintain a safe network, energy consumption read outs, vehicular maintenance warnings, and the like, and are generally not automated.

Thus, there currently exist deficiencies in monitoring and managing traffic flow.

SUMMARY OF THE INVENTION

Accordingly, one aspect of the present invention is to provide a system for monitoring and managing traffic flow. The system includes (i) a plurality of remote sensor devices arranged in a plurality of vehicles, (ii) a plurality of remote communication hub devices operatively arranged along one or more roadways and in communication with the plurality of remote sensor devices, (iii) a central server, (iv) a network interface in communication with the central server and the plurality of remote communication hub devices over a network, and (v) a shared database in communication with the central server. The central server is configured to: (i) receive traffic data from the plurality of remote sensor devices over the network, (ii) update traffic data in the shared database, (iii) periodically calculate an optimal traffic flow for one or more of vehicles traveling along the one or more roadways based on the updated traffic data, and (iv) transmit timing adjustments over the network to one or more traffic light intersections based on the optimal traffic flow calculations. The network interface is configured to send and receive traffic data, wherein the traffic data includes vehicle location information.

Another aspect of the present invention is to provide a method for a computer program product embodied on a computer readable medium for monitoring and managing traffic flow. The computer program product includes (i) a first computer code for receiving traffic data from a plurality of remote communication hub devices operatively arranged along one or more roadways and in communication with a plurality of remote sensor devices arranged in a plurality of vehicles over a network, (ii) a second computer code for updating traffic data in a shared database, (iii) a third computer code for periodically calculating an optimal traffic flow for one or more of vehicles traveling along the one or more roadways based on the updated traffic data, and (iv) a fourth computer code for transmitting timing adjustments over the network to one or more traffic light intersections based on the optimal traffic flow calculations. Each of the plurality of remote sensor devices comprises an RFID and a GPS module.

BRIEF DESCRIPTION OF THE DRAWINGS

A more complete appreciation of the present invention and many of the attendant advantages thereof will be readily obtained as the same becomes better understood by reference to the following detailed description when considered in conjunction with the accompanying drawings, wherein.

DETAILED DESCRIPTION THE PREFERRED EMBODIMENTS

Figure 1A:
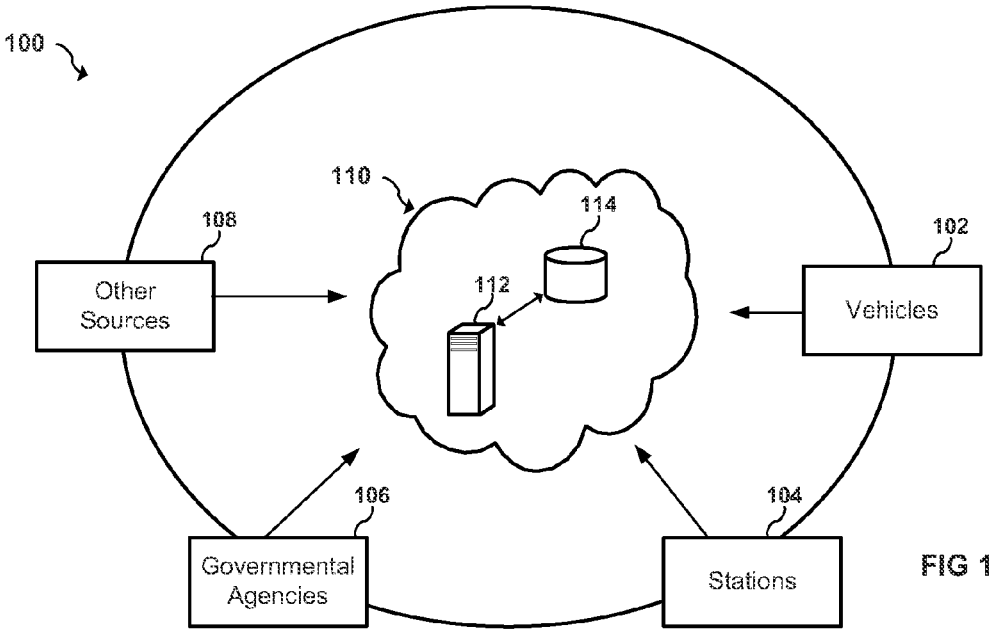
FIGS. 1A-1D are block diagrams illustrating a system for monitoring and managing traffic flow in accordance with an embodiment of the present invention.

Referring now to the drawings, wherein like reference numerals designate identical or corresponding parts throughout the several views, preferred embodiments of the present invention are described.

The present invention relates to an apparatus and system for monitoring and managing traffic flow in a road network in an area served by one or more receiving stations receiving geographic positional and other data from one or more vehicles. According to one embodiment, the geographic positional data from one or more vehicles may utilize devices having the Autovecth Integrated Chip Set (RFIDGPS), also referred to "AVICS" devices. According to other embodiments, the geographic positional data is received from commercially available consumer devices, such as without limitation, mobile phones, smart phones, PDAs, GPS receivers and the like. The geographic positional data may include information received without limitation from satellites and the like. The geographic positional data may be in the form of a geographical position such as longitude and latitude, also known as longlat, or may be other forms which can be converted into such a form. The information collected on the progress of the individual vehicles can be used to dynamically calculate the combined average speeds, transit times and proportional location of each vehicle. The information collected may also include recommended traffic congestion options, alternate routes, emergency and/or dignitary vehicle travel variables. The data received from each vehicle's processor include but is not limited to fuel consumption data, maintenance information, mechanical information from onboard vehicle processors, CO2 output, emergency information calls, and the like. As used herein, the term "OBVIPRO" refers to an onboard vehicle processor.

Receiving stations include one or more sensors and/or receivers strategically placed along various roadway, park, and walk-way locations, and the like. As used herein, roadway locations include, without limitation, municipal traffic lights, intersections using stop signs, lighting circuits, camera feeds from fixed or stationary local highways parks, walking trails, secondary roads, freeways and interstate roads, rest stops, bridges, landmarks, municipal buildings, selected freeway mile markers and other common areas.

According to the present invention, existing wired and wireless networks, wide area networks, ad-hoc networks, and systems may be modified for continuous data feeds from one or more receiving stations woven into a dynamic computational algorithmic architecture (DCAA). According to one possible embodiment, communication is received from one or more communication devices, sometimes referred to as "tVector Hubs" or "hubs", strategically placed at roadway locations and/or other locations. The network may optionally be enhanced to handle the network data necessary to manage the traffic flow in real time, make suggestive analytical calculations to advance hands free driving. Such data includes data received from, and/or to, the one or more sensors, receivers and/or vehicles. Traffic flow management includes automatically presenting alternate routes, granular decelerate/accelerated speeds recommendations, accident updates, planned maintenance along with growth projections, congested routes or intersections, light failures, and the like. Traffic flow management may be directed towards traffic lights at one or more traffic intersections to adjust the general traffic flow light timing at traffic intersections. Traffic flow management may also be directed towards specific vehicles to suggest alternate routes, and granular decelerate/accelerated speeds recommendations.

According to one possible implementation, the IEEE 802.11 protocol may be utilized for communication with palmtop computers, laptop computers, personal digital assistants (PDAs) and Internet mobile phones. The 802.11 standard specifies two modes of operation: (i) an infrastructure mode where an access point provides the link between wireless stations and wireline legacy infrastructure, and (ii) an ad-hoc mode where there is no access point. By using tVector Hubs to collect real time data that is feed into a central processing complex, each tVector Hub contributes to the distributed management and control of the entire network.

According to one possible implementation, the operating system is built on a Unix platform. According to this non-limiting implementation, verifications of tVector Hubs occur routinely in sequential random patterns. Notifications are sent out to each tVector Hub for authentication purposes, to verify integrity of each unit using a cryptic VPN connection. The network may utilize Crypsis Tokenization. Each tVector Hub is routinely verified by a data push, which may or may not be encrypted, for original data composition. On deployment the token is placed within each tVector Hub's core operating system. If the tVector Hub loses power, is hit with a power surge, or has otherwise been compromised, then the tVector Hub data may rolled back and/or a secondary internal board may be activated (or if necessary, the module can be replaced quickly).

According to one embodiment, test tokens are sent to verify operational areas for data integrity composition inspections. If any of the tVector Hubs are not the same as its original encrypted token, the tVector Hub data is rolled back. Off-line for maintenance and operating system updates, hardware failures/software updates may be propagated throughout the system with redundant server capacity to maintain operational up-time. The data from tVector Hubs may be sent via one or more token sets for security protocols originally implanted.

One of the benefits of RFIDGPS integration is the ability to track multiple mobile devices onboard vehicle processors establishing GPS isolation integration, such as without limitation, OBVIPRO, pAvics, cameras with stationary of fixed feeds, street lights and smart devices simultaneously within any given networks framework, such as without limitation a city, a township, a railway, highway, freeway, river or the like. Since this intermixing of network packet traffic variables, having a reserved IPv(set), along with subsets for each municipality, can be tracked within any framework by transmitting a radio frequency identifier from/to any type of vehicle, smart devise or the like. The system relies on several tVector data points for redundancy.

Utilizing a (Stationary Hub Identifier) SHID that has a dedicated IPv(set), that reflects the ESN or other unique cellular identifier assigned to each Avics within each tVector Hub and OBVIPRO, signal integration interactions allow data message transmissions from/to each independent tVector Hubs, OBVIPRO, pAvics (also known as Portable Avics) and the like. Forming a wired/wireless ad hoc framework is essentially expedited with the direct communication from/to each device that has a unique RFIDGPS identifier encapsulated within using integrated cellular capabilities for enhanced distances, and for redundancy. Each municipality can deploy that communication process that is most readily available to maintain cost implementation in the beginning, with migration over to the most current com links at a later date.

Communication is transmitted from/to each tVector Hub, that picks up data from each vehicle's OBVIPRO, compiling simple data that creates complex fuel consumption variables, engine analysis, longlat positional points in relation to other vehicles and speed variations of each, from each vehicle that passes through, around or above these hubs. Data collection is transmitted with multiple com links (e.g., wireless, electric lines, Wi-Fi or gigabit wide/local or obstacles on road-ways or other driver hazards networks or by other currently known technologies) to Xgenasys, by analyzing the dynamic analytical rate flow (DARF) in comparison to dynamic analytical lane allocations available, along with dynamic directional flow constraints from calculated inputs from network traffic congestion artifacts. This process, computational traffic flow dynamics draws principles from the fields of cross-layer optimization, artificial intelligence, machine learning creating a dynamic computational algorithmic architecture from the dynamically compiled data extracted or received from each device on any local or wide area network that is linked together from each hub and every on board processor that comes into range of any mechanical receiving/transmitting device deployed. Creating a mechanism characterized by substantially constant motion, using electronic devices processing calculable rules, from continuous inputs creating a logical conceptual design.

Network packet artifacts are determined by sending out a transponder echo call to make sure that any OBVIPRO that registered on the network, has arrived at destination or is off network. If there is no reply from echo request calls from tVector Hubs in the area of any given OBVIPRO's last known location, Xgenasys calculates a comparison to the whereabouts of its location now in relationship to where it is at present.

Further, another example is when Xgenasys searches local OBVIPRO trace routes is to determine system networks average speed, in isolated area networks for flow rates and the like.

RFIDGPS integration eliminates the environmental challenges currently in place in having a high concentration of mobile devices moving at variable speeds. A comparison from each device is able to differentiate a numerical value (such as, without limitation, the OBVIPRO VIN number) and location associated with each device. Thus allowing an infinite number of derivatives combined into a single analytical recommendation for rapid traffic congestion flow analysis.

The present invention radically improves mobile locational devices over an ad hoc wired or wireless framework, including fixed or mobile cameras for high crime rates, traffic violations and the like. Communications from digital packet data, consisting of various transmitting devices, enables a medium that is responsive to each application. Further management includes selectively powering down street light when traffic is at its lowest, thereby further reducing our fossil fuel supply consumption rate by implementing this Nxgen traffic system—Xgenasys, allowing vehicles to move as fast as possible without unnecessary idling, speed bursts and safely from these various navigational inputs. Each vehicle will eventually be able to navigate itself, from calculated recommendations, will allow reactive response interval feeds into each onboard vehicle processors system that emulates full auto pilot control, driver take over is obtained by voice command statement (e.g., release auto or manually turn off).

Traveling is enhanced by feedback to/from the system of the present invention that recommends a planned route based on communications, also known as iVoiceCommands (iVocx) within a vehicles onboard vehicle processor or smart devices that recompute travel time variables, along with Network Traffic Congestion Artifacts (NTCA), based on information received from tVector Hub modules. Integrating onboard object functionality points (sensors on sides, rear, front of vehicle) detection, also known as a proximity integration feed to Xgenasys, allows prompt reactive response interval feeds into onboard systems allowing each OBVIPRO the ability that further encapsulates logistical response times on preventative measures regarding accidental collisions.

According to one embodiment, maintenance data from a vehicle's OBVIPRO is pushed to tVector Hubs using an authenticated predefined data format and routinely checked for data integrity composition. This authenticated predefined data format is accumulated and analyzed for emission codes outside regulatory guide lines, inspection and tags validity, and archived and shared with both state/federal DOT and dealers as a PDE (paid service event) for appropriate determination of service recommendation advertisements. These service recommendation advertisements are sent back to the OBVIPRO and include without limitation an indication that the vehicle is need of some repair, scheduled maintenance, and the like.

According to one embodiment, the present invention monitors commercial vehicle speed, physical location, braking and acceleration patterns, rapid lane changes with warnings to other local OBVIPROs, specific time of day events, rest time recommended intervals for personal and commercial vehicles, destination arrivals, maintenance items, inspections, weight loads and the like. This information is used to provide data needed for risk-adjusted representation to improve road safety for every driver and provide a safer landscape that lowers insurance premiums for the trucking industry and possibly provided as a PDE and revenue share with DOT. The locally accumulated data is shared with state and federal DOT.

According to one embodiment, Avics, pAvics, tVector Hubs and Xgenasys and other devices deployed, conforms to the American trucking associations (ATA) standard. Truckloads (trailers) are monitored and continuously tracked, thereby maintaining the shipment location whereabouts at any given time and possibly shared as a PDE for purchasers and insurers. Such information allows shipment costs and fuel consumption variables to be monitored on a minute scale. Using traffic congestion lane variables, management decisions can be made to close certain lanes for certain types of traffic (only trucks) during peak movements, thereby maneuvering traffic (packet) rates based on (packet) flow rates. By analytically resolving how much traffic is exposed and or expected on different paths in advance (going to/from), calculable suggestions are qualified by Advance Congestion Flow Routes (ACFR) in conjunction with Dynamic Analytical Rate Flow (DARF).

Further, traffic may be managed based on personal inputs or by system pre-configured or decided routes, example trips to and from work. Once these destinations are entered into onto a vehicle's OBVIPRO, Xgenasys computes traffic variables based on driver inputs. Xgenasys computed data routes can be uploaded through smart devices using pAvics (portable Avics) application hardware for older cars, can be added with a simple plugin module on vehicles with OBD capabilities, that only check for basic engine functions, such as without limitation O2 sensor operation and the like. This module interacts with the pAvics application on any smart device that provides a similar navigational experience.

The pAvics may be integrated with current locational services in smart phones thereby allowing particular usage for cyclers, runners and motorcycles along with instant 911 services.

Some tVector Hubs may be configured read-only while others may be configured with read/write tags that hold multiple pages of variable (changeable) data and/or fixed (unchangeable) data. The read/write tag may include read and write encrypted password protection and allows communication over an extended area or a number of lanes. Data can be updated on the tag as quickly as it passes a reader. More advanced tags may be configured with audio and visual indicators, and a message display for OBVIPROs or pAvics. These tags may be configured to use sound and light emitting diode (LED) and/or liquid crystal display (LCD) readouts to report the status of each data or toll transaction or in the case of emergency or dignitary vehicles and arrows on onboard vehicle processors displays to indicate to move right or left depending on calculable variations from current traffic artifacts and come to a stop until EMV or the like passes. With read-only tags, the data may be fixed, these services offered maybe offered as a PDE for advanced system integrations.

According to one embodiment, the present invention includes one or more RFID transmitters and receivers. A basic RFID system consists of tags, antennas, and readers. The reader's radio frequency (RF) source is either integrated or a separate component. The reader broadcasts RF energy over an adjustable area called the extended read zone or reader footprint. The tag on the vehicle reflects a small part of this RF energy back to the antenna. The reflected radio waves denote the tag's unique identification code and other stored data. The antenna relays the signal to the reader, which can add information such as date/time, vehicle's VIN# to the tag's identification code, and stores it in a buffer. The reader can then transmit the tag's identification code along a communication network to one or more processing systems, when traveling on a pre-configured route or a vehicle that has just entered the same route for a partial distance.

Incorporating modulated backscatter technology allows readers to communicate with tagged objects traveling in excess of the normally specified 100 miles per hour (160 kilometers per hour). This technology can also operate from as far away as 100 feet or more (30.5 meters). This highly stable, reliable, and reflective method of wireless or wired reader-to-tag communication allows automatic identification equipment within vehicles that transmits vehicles VIN# as a unique identification and other pertinent requested data.

According to one embodiment, reflective, or passive, tags are used instead of traditional transmitter or "active" tags. Because the tag simply reflects the reader's signal, there are no frequencies to synchronize, and interference from other radio frequency sources is rare. Frequency changes can be made in the reader, eliminating tag recall. Further, reflective tags require less internal power than traditional transmitter tags so they have a longer life. They also have greater range than bar code, infrared, or other passive systems.

As is known in the art, an RFID tag is defined as active if a battery inside the tag housing provides power to the tag or the tag is connected to an external power source. A tag is defined as passive if it has no battery. In applications that use passive tags, RF energy from the interrogator powers tag circuits. The choice of active versus passive tags has consequences for overall system cost, initial tag cost, tag life, and battery life.

Passive tags have a lower overall cost due to low-cost tags and long tag life. The lifespan of passive tags is indefinite because the tag has no battery. The choice between active tags and passive tags is related to other system design issues. Active tags can support higher data rates and higher chip processing speeds, but passive tags also support data rates and chip processing speeds that are suitable for high-performance applications such as toll. Active tags can support user interfaces (lights and LEDs), but tag interfaces reduce battery life. A disadvantage of passive tags is that some countries do not allow sufficient interrogator power and suitable RF frequencies to support the range necessary for some high-performance applications.

Active tags have a higher overall cost in ownership including battery changes. Battery life is a primary concern for reliability and for cost of operation. In toll applications, for example, battery outages, which can cause RFID transactions to be processed as violations, are expensive and time-consuming both to users and toll road operators. Battery life depends on the battery capacity and the long-term average power drain. An overall view of tag cost must assess tag replacement costs for tags with fixed batteries or battery replacement costs for tags with user-replaceable batteries. Thus, each Avics inside tVector Hubs is equipped with solar panels to prevent outages and are equipped with either both passive and or active read or read/write capabilities for any given deployment variable.

According to one embodiment, the remote sensor devices include an RFIDGPS module integrated with cellular capabilities for extended coverage due to environmental errors, such as without limitation weather, solar flares, and the like. Each tVector Hub may be configured to be routinely verified by an encrypted data push for original data composition. On deployment a token is placed within each unit's core NOS (also known as the nuclex operating system). If the OS is hit with a breach, such as a power surge, or the OS has been compromised, then the OS is rolled back to from a primary call from Xgenasys to revert to the encapsulated original NOS status, deleting the older version—using current secure remote deletion technology. The data sent to each tVector Hubs is sent via one or more 'token sets' to each hub's OS for security purposes, originally implanted as a unique identifier.

Xgenasys may include theft protection. If a vehicle, including a truck, is stolen and owner notifications are sent via a mobile application to Xgenasys, the present invention may be configured to send a deactivate command to OBVIPRO when the vehicle is not moving for safety reasons and or in a parking lot area, with possible siren activation. The GPS navigational location is sent to local authorities for pickup and investigation. This also maybe a shared PDE that may in turn see a reduction in insurable risk and reduced premiums.

According to one embodiment, each Avics module is locked and hard coded into each OBVIPRO to prevent tampering. A fail safe code may be applied. If tampered with, the vehicle will not start and only a dealer will have the ability to re-activate, similar to key codes.

According to one embodiment, all sub-navigations systems, also known as (Subnavsys) (e.g., cameras and or mobile cameras for trouble areas, street lighting, traffic lights, tVector Hubs and OBVIPRO's and the like) are separate from each other on inputs to Xgenasys. Data feeds are compartmentalized for each device for security reasons. Data collections are verified as to VIN#'s locational address, results are computed and sent to Xgenasys to complete computational recommendations through a secure one-way VPN connection. At times archived data requests are sent to separate archived encrypted traffic data repositories using specific data call points (time intervals) for a particular sub-navigational system for analytical comparative computations or possibly for legal occurrences in the event of an accident at any given intersection or otherwise.

Intersections that have accidents, requesting these call points prior to accident time-frame, can be retrieved from municipal repositories, in the event of a lawsuit filed. The data records, not only for locational access points for every vehicle within a pre-configured requested time frame or specific distance from event, from those vehicles that approached the intersection along with the camera data images retrieved will coincide with vehicle speeds in proportion to other vehicles at the time of incident.

According to one embodiment, sentinel hubs are used in school zones to protect children and in areas of known speeding occurrences. These Hubs may be placed without limitation into small concrete structures by school zones light poles and use the steel pipe as an antenna, unbeknown to passing traffic. The amount time saved versus the revenue to expense in respect to safety officers can broaden the scope of this tech feed to minimize reaction times and save fuel and shifting man power to other needs.

Utilizing GPSRFID isolation integration, the location of each OBVIPRO (vehicle) is determined at all times, throughout the network, creating a dynamic isolation architecture that Xgenasys uses to compute traffic variables quickly.

The present invention may be configured to include communications to/from each onboard vehicle processor, by either a vehicular driver initiated turn signal or by Xgenasys computational system suggestions. Each activation (e.g., turn, brake, and the like) in conjunction with vehicles operational request or system driven inputs to OBVIPRO that activates a turn signal request, and the like, in turn will provide advance notification features given with or without iVoice-Commands or just visual displays of these commands on OBVIPRO's screen.

The driver will know in advance of these operational maneuvers. These calculative suggestive corrections during a planned destination or an excursion can signal other OBVIPROs, with adjustable variations to allow lanes changes or driver brake responses from other vehicular movements that is system generated or by human intervention.

According to one embodiment, observations or call points may be provided to every vehicle on a given network in a localized area in relationship with other networks, computing pre-configured speeds, lane turns and the like. An onboard vehicle processor sends out advisements on road conditions from each OBVIPRO as to the volume of vehicles at any given time intervals with speed variations sending back calculated suggestions and the like. Xgenasys obtains historical markers from each OBVIPRO, that later is used to calculate future conditions on road congestion, maintenance problems and/or expansions and the like, along with driver inputted obstacles on road-ways.

According to one embodiment, cVector (construction vector) Hubs are utilized for construction areas. cVector Hubs are temporarily deployed at the beginning of each road construction work zone. cVector Hubs are configured to broadcast warnings or signals relating to speed reductions, route alterations, hazards, and the like, resulting from the construction area. The information provided by the cVector Hubs can be changed on will call basis so that modifications are updated as needed, due to contraction completion, etc.

When construction permits are pulled to begin work, contracting entity requests for a registered cVector Hubs (Construction Vector Hubs) to be deployed by city and or state personnel.

The warnings or signals broadcast by the cVector Hubs are received by any approaching vehicles and pAvics devices (Portable Avics, such as smart phones, etc.). Since integration in the OBVIPRO for older vehicles are not available in the first part of implementation stages towards full deployment, utilizing pAvics will assist with full migration concerns, until older vehicle go out of service.

The next generation of pAvics can tie into older vehicles on board processor and extract only minimal data records, such as C02 functions, location data, and the like. This can be arranged or built into a full screen, like a larger Garmin, and the like, by merely plugging the pAvics into the OBII connector under dash, similar to when user's updated their older vehicles from AM radio to AM/FM cassette, then onto FM/CD, etc. A pAvics device can have a LCD, slide out screen from under the radio device, and provides similar functionality to newer cars OBVIPRO's in detecting data transmissions from Xgenasys.

Figure 1B:
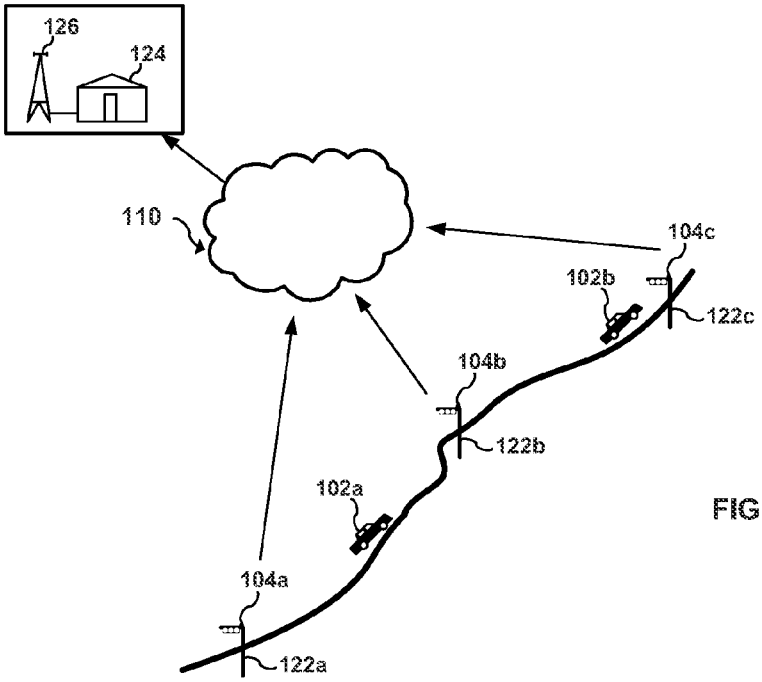
Figure 1C:
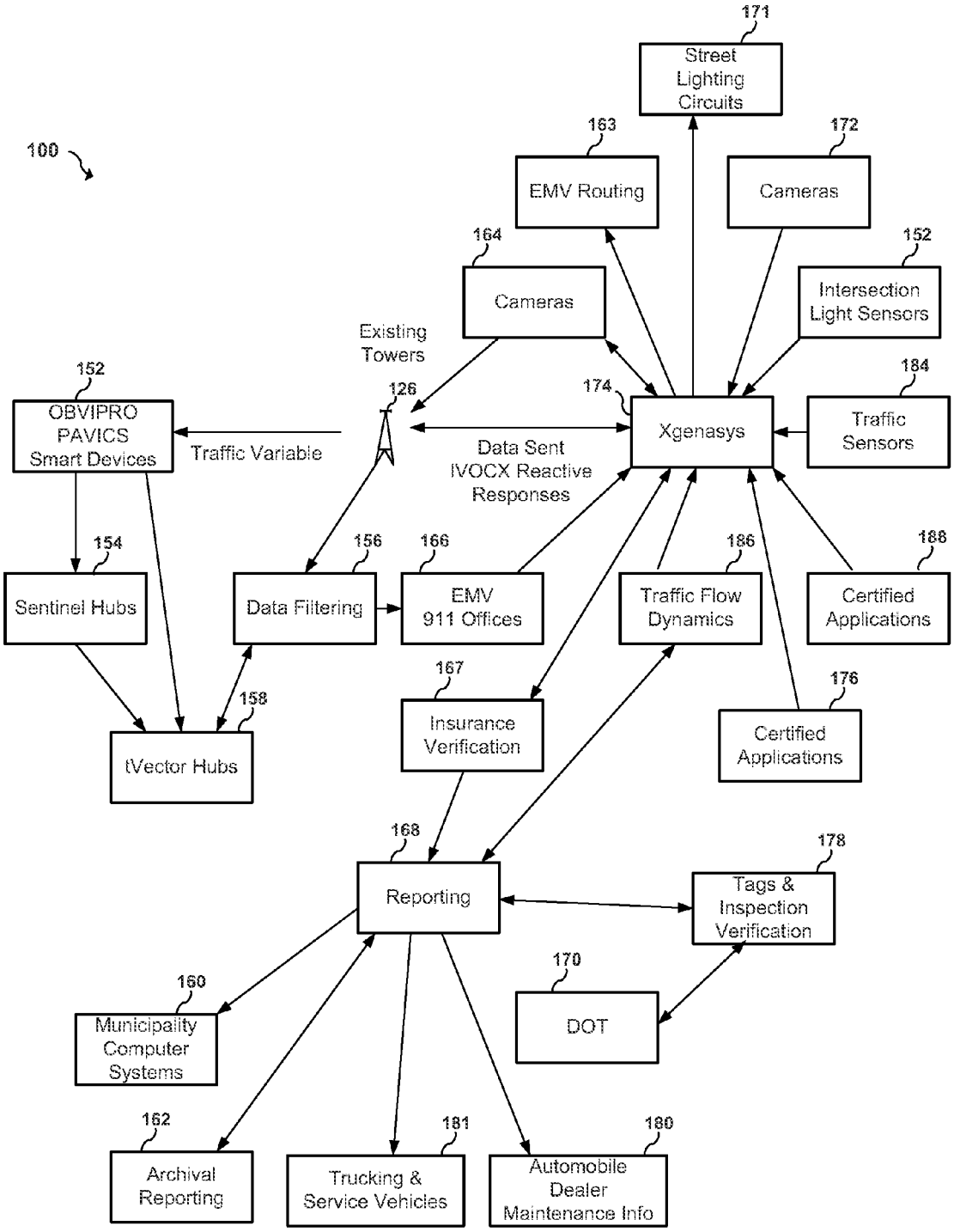

Referring to FIGS. 1A-1D, block diagrams illustrating a method for monitoring and managing traffic flow in accordance with an embodiment of the present invention are shown. According to this embodiment, the system includes one or more computers 112 in communication with one or more databases 114. The one or more computers 112 are in communication via a network 110 with a one or more vehicles 102, one or more receiving stations 104, one or more governmental agencies 106, and optionally other sources 108. The one or more vehicles 102 are equipped with one or more sensors that periodically transmit data to the one or more receiving stations 104. The transmitted data includes geographic position data for the one or more sensors onboard the one or more vehicles 102. As shown in FIG. 1B, as the one or more vehicles (102*a* and 102*b*) travel along one or more roadways, they periodically come within range of one or more receiving stations (104*a*-104*c*) (or tVector Hubs) attached to respective one or more roadway locations (122*a*-122*c*). The one or more sensors on the one or more vehicles (102*a* and 102*b*) may include RFID and/or GPS modules along with cellular capabilities for enhanced distance. Data from the one or more vehicles (102*a* and 102*b*) is transmitted via the one or more sensors on the one or more vehicles (102*a* and 102*b*) to the one or more receiving stations (104*a*-104*c*) within range. The data is transmitted to one or more computers 112 in communication with one or more databases 114. Without limitation, such transmission may utilize existing wired or wireless gigabit networks or new communication networks or using electrical lines. For instance, the data may be communicated wirelessly to a communication tower 126 which is then relayed to the one or more computers 112.

The one or more computers 112 calculate the likely individual routes of the one or more vehicles (102*a* and 102*b*) and the estimated transit time based on the received geographic positioning data received respectively from the vehicles. The individual routes and times are refined as new geographical positional data for those vehicles is periodically received. This may be achieved by a number of different positional system technologies which are available for calculating geographical positional information. The road data used in the present invention is generally in the form of an encrypted data file.

Figure 1D:
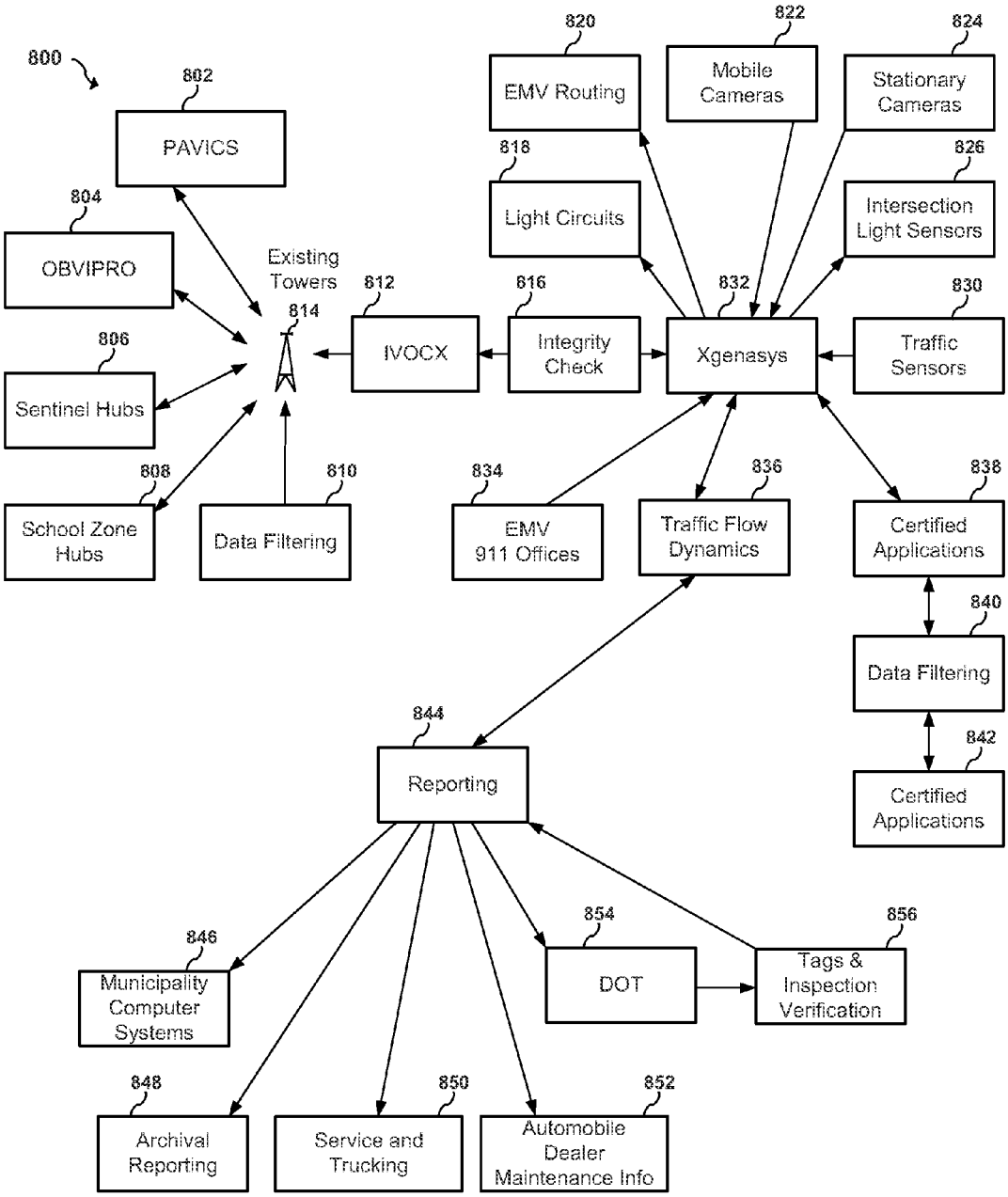

FIG. 1D is a block diagram illustrating a method for toll roads providing overall procedural steps during a pre-configured trip to work.

Referring to FIGS. 2A-2F, flow charts illustrating a method for monitoring and managing traffic flow in accordance with an embodiment of the present invention are shown. As shown at block 204, if a vehicle is within range of a receiver/transmitter, then processing continues at block 206, where a signal is received from the vehicle. The receiver may be an RFID GPS or other wireless receiver or the like. The vehicle sensor data is received by the receiver and communicated to the server at blocks 208-210. At block 212, the vehicle sensor data is stored in a database along with data received from other vehicles. The geographical positional data is filtered to ensure data integrity using each vehicle's VIN# against archived data, at block 214.

An optimal traffic flow pattern is periodically calculated at block 216 using vehicle sensor data from multiple vehicles over time. This optimal traffic flow pattern may be based on without limitation road congestion. An indication of road congestions may be calculated as the difference between the calculated average speed and the normal average speed. Further, by counting all of the vehicles using a particular road, it is possible to estimate the volume of the traffic on the road. These trends and effects of changes can be analyzed and properly reduced to merely topography and climatic expectations, in conjunction with expected human response efforts feed from each OBVIPRO that is blended within the networks status. By analytically resolving how much vehicular traffic is exposed and/or expected on different paths in advance going to/from, calculable suggestions are qualified and quantified by advance congestion flow routes in conjunction with dynamic analytical rate flow (DARF).

At block 218, topography and climate data is integrated. Traffic flow modification information is sent to manage and modify the general or specific traffic flow, at block 220. This traffic flow modification information may be directed towards traffic lights at one or more traffic intersections to adjust the general traffic flow light timing at traffic intersections or freeways and toll roads. Traffic flow modification may also be directed towards specific vehicles to suggest alternate routes, and granular decelerate/accelerated speeds recommendations, also known as impulse speed variation recommendations, from the tVector Hub modules that can be reduced down to analyzing the entire system area so that a continuous movement is in place. At block 222, data is pushed to the OBVIPRO, for system area corrections compared against surrounding data inputs. Trip variables may then be recalculated at block 224.

Figure 2A:
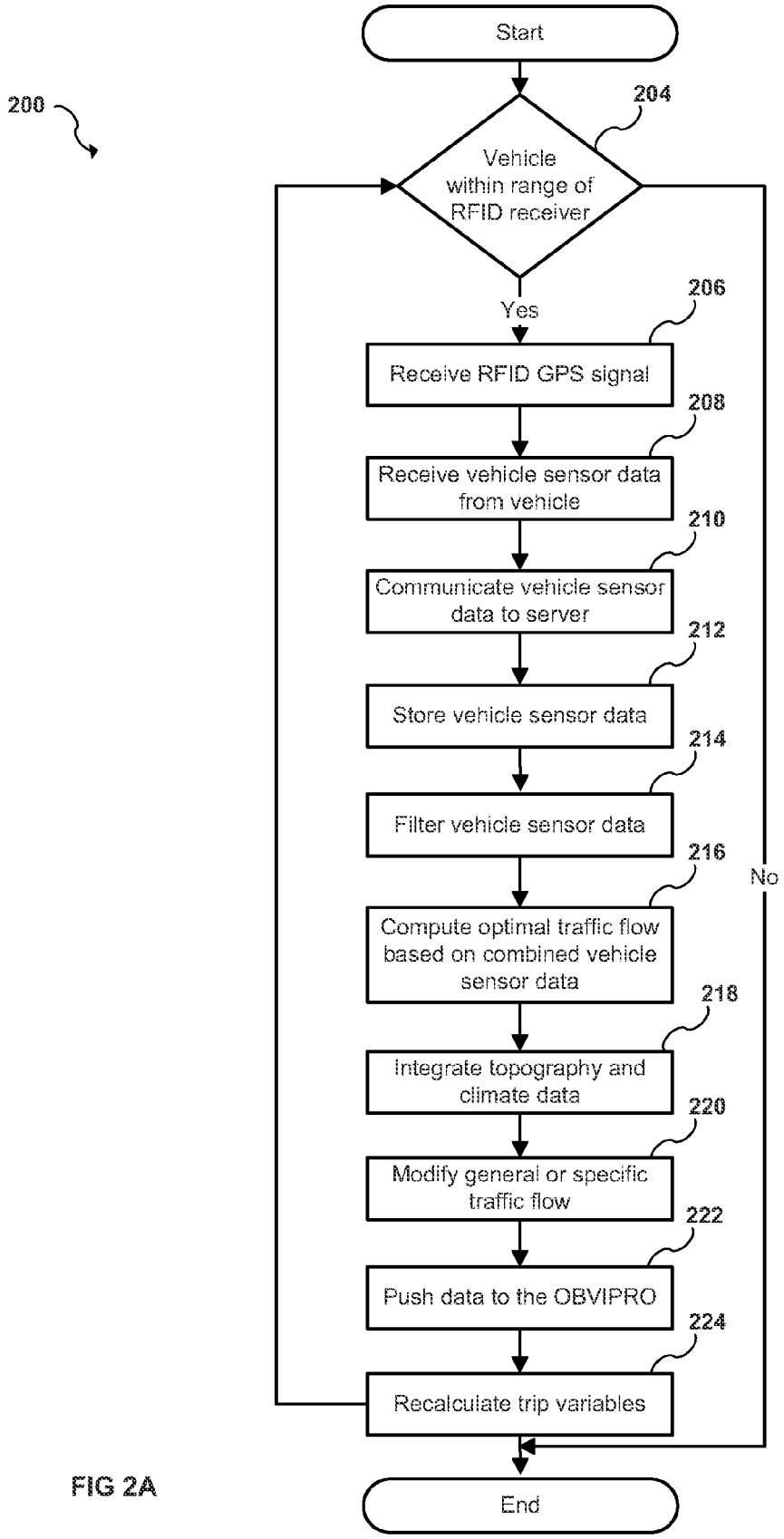
FIGS. 2A-2F are flow charts illustrating a method for monitoring and managing traffic flow in accordance with embodiments of the present invention.
Figure 2B:
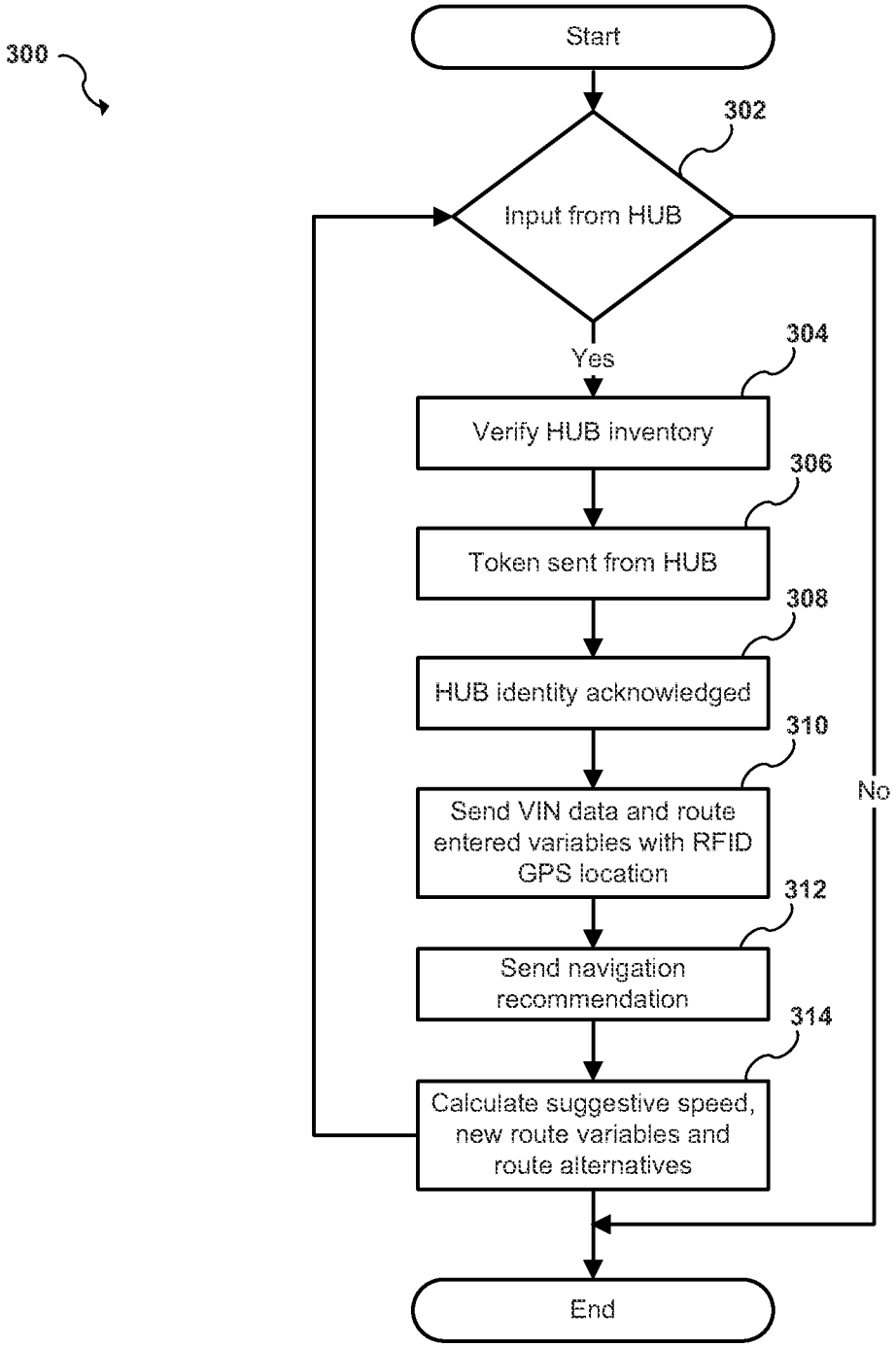

Referring to FIG. 2B, a flow chart illustrating a method for monitoring and managing traffic flow illustrating communication between Xgenasys, tVector Hubs and each OBVIPRO in accordance with an embodiment of the present invention is shown. As shown at block 302, whether there is any initial input to a localized tVector Hub from any onboard vehicle processor is determined. If there is initial input to a tVector Hub, then processing continues at block 304, where the tVector Hub inventory is verified. At block 306, a token is sent from the tVector Hub to Xgenasys. Xgenasys acknowledges the tVector Hub's identity, at block 308. At block 310, vehicle identifying information (VIN) data and route entered variables with RFIDGPS location is sent from the tVector Hub to Xgenasys. Navigation recommendation requests are sent to OBVIPRO at block 312. At block 314, suggestive speed, new route variables and route alternatives are calculated.

Figure 2C:
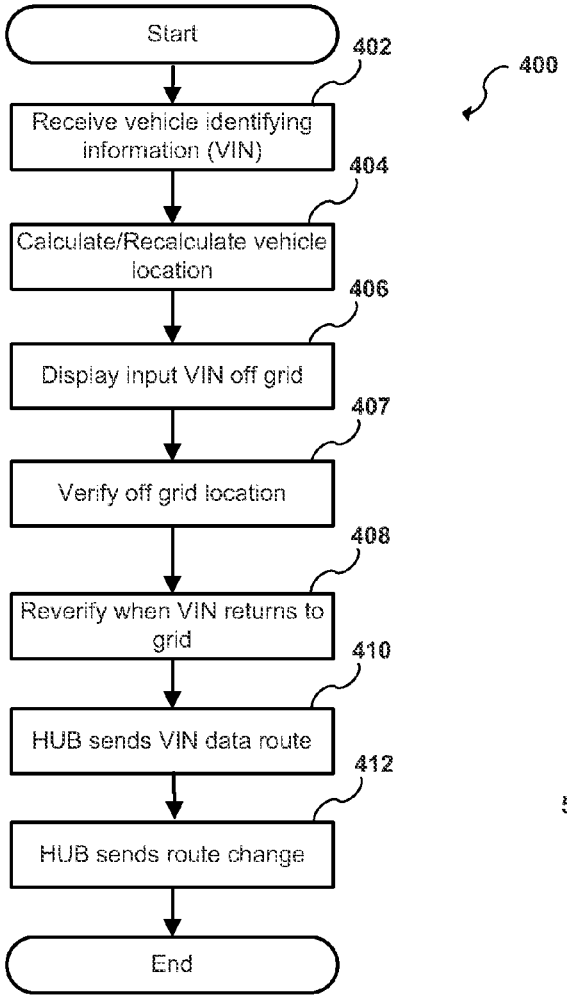

Referring to FIG. 2C, a flow chart illustrating a method for monitoring and managing traffic flow illustrating the Xgenasys system in accordance with an embodiment of the present invention is shown. As shown at block 402, vehicle identifying information (VIN) is received. The vehicle location is calculated and/or recalculated at block 404 using input from one or more tVector Hubs. At block 406, any off grid VINs are displayed. At block 407, eco call verifies whether the vehicle is off grid. VIN returns to the grid at block 408. A re-verification occurs when the VIN returns to the grid. At block 410, the tVector Hub sends the VIN data route. Route change information is sent at block 412.

Figure 2D:
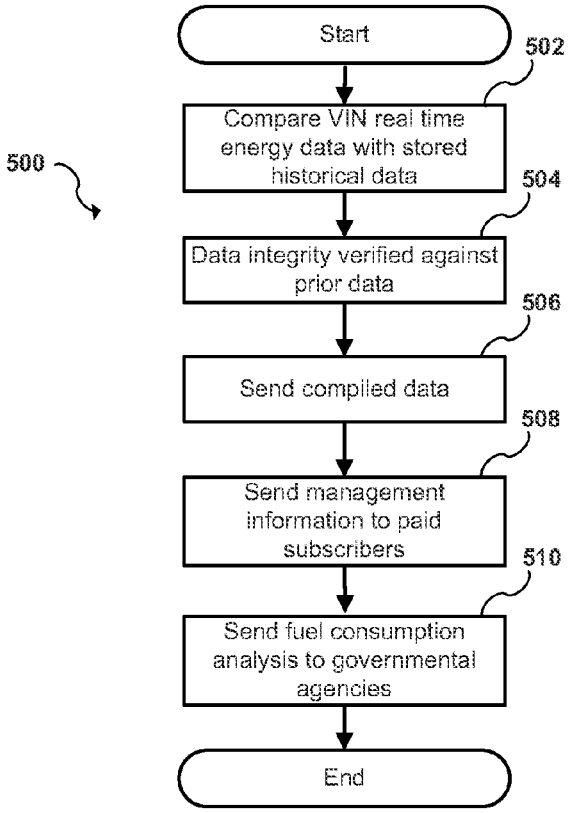

Referring to FIG. 2D, a flow chart illustrating a method for monitoring and managing traffic flow illustrating the sub navigation system in accordance with an embodiment of the present invention is shown. As shown at block 502, VIN real time energy data is compared with stored archived historical data. The integrity of the data is verified against prior data at block 504. At block 506, this information along with other compiled archived data is sent to Xgenasys for calculations. Any management information may be optionally sent to paid subscribers at block 508. At block 510, fuel consumption analysis is optionally sent to one or more governmental agencies.

Figure 2E:
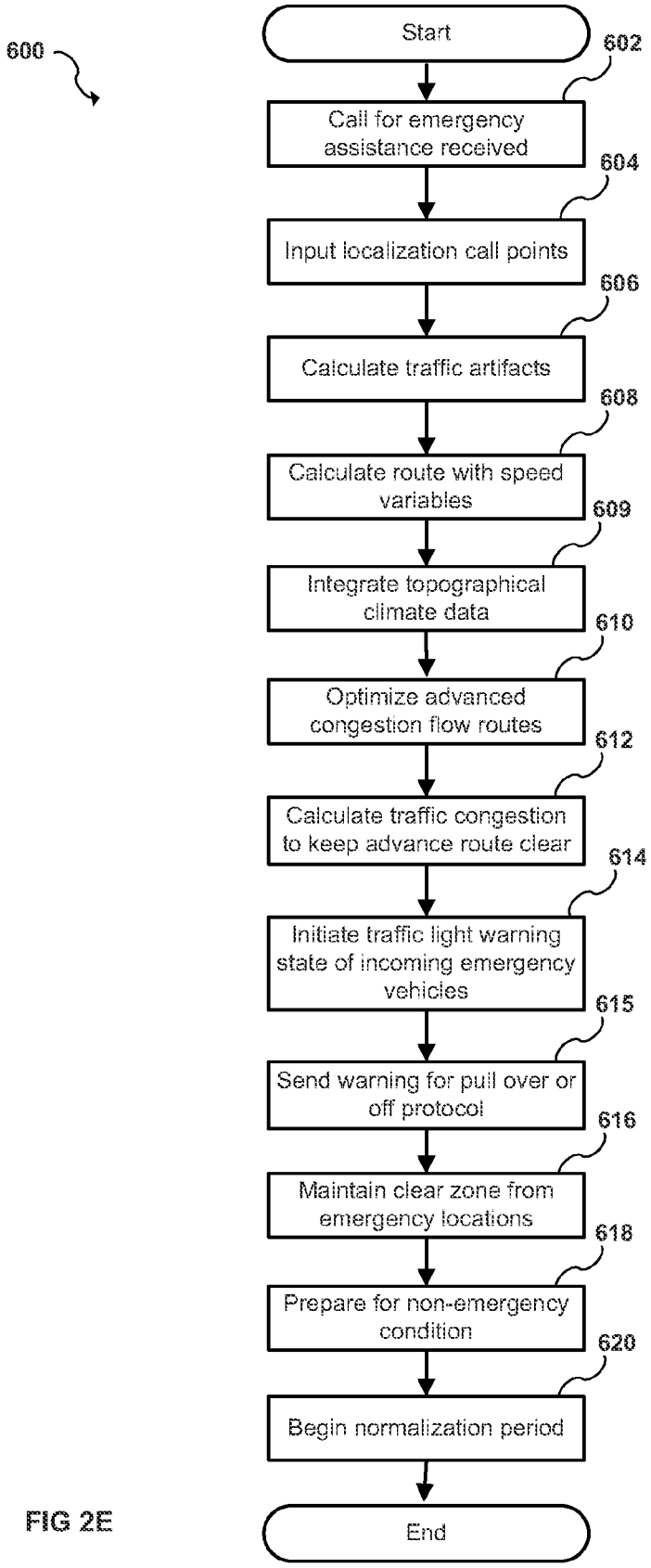

Referring to FIG. 2E, a flow chart illustrating a method for monitoring and managing traffic flow illustrating emergency vehicle routing in accordance with an embodiment of the present invention is shown. At block 602, a call for emergency assistance is received. The localization call points or route vectors are input at block 604. At block 606, network traffic congestions artifacts are calculated. An optimal traffic flow pattern is periodically calculated for the emergency vehicle to reach its desired destination at block 608. At block 610, congestion flow routes are calculated, based on vehicular localization compared to the emergency vehicle route (or "EVR").

At block 612, traffic flow modification information is sent to manage and modify the traffic flow for the emergency vehicle to optimally reach its desired destination. This traffic flow modification information is typically directed towards traffic lights at one or more traffic intersections to adjust the general traffic flow light timing at traffic intersections, at block 614, which may include initiating a traffic light warning of incoming emergency vehicles. The traffic light warning may be of any type including, without limitation, flashing lights and the like.

At block 615, activation of advance warnings sent to each OBVIPRO within the emergency vehicles route, via hubs or wirelessly along the route, thru voice commands and visual warnings on OBVIPRO, using arrow indications of the direction to pull over to. A clear zone to be maintained for the emergency route location(s) is created, at block 616. At block 618, the system is prepared for a non-emergency condition. The normalization period begins at block 620.

Figure 2F:
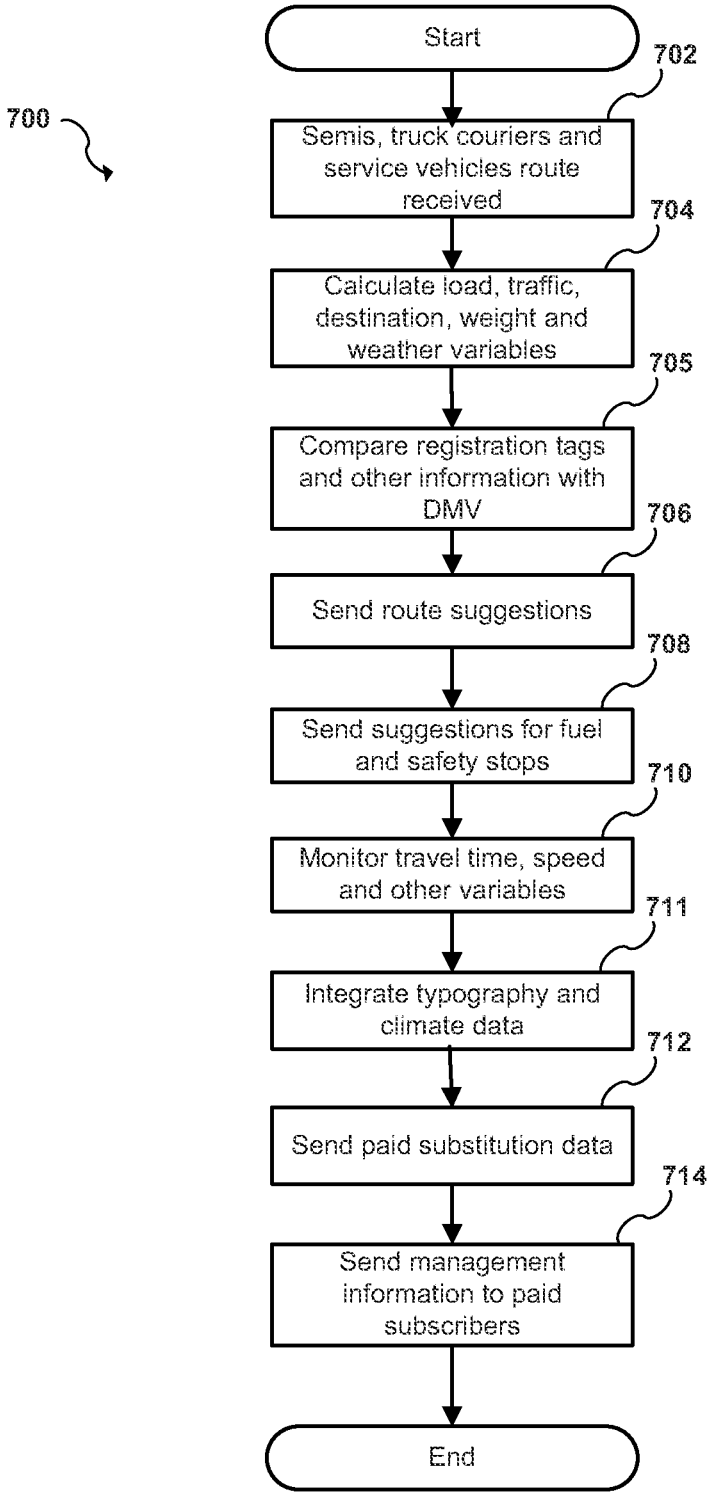

Referring to FIG. 2F, a flow chart illustrating a method for monitoring and managing traffic flow illustrating tracking commercial vehicles in accordance with an embodiment of the present invention is shown. At block 702, the destination route is received for a semi-truck, truck courier or service vehicle route. The load, traffic and weather variables are calculated at block 704. At block 705, registration tags and other information is compared against DMV records. At blocks 706-708, route, fuel and safety stops are transmitted. The travel time, speed and other variables are monitored at block 710. Typography and climate data are integrated at block 711. Optionally, substitution data and management information is sent to subscribers, at blocks 712-714.

According to one embodiment, a user interface is provided to allow user access to the geographical position data over a computer network. Historical geographical positional data or any other stored on the server may then be viewed over the network, such as the Internet, as a PDE by subscribers. These subscribers can send entertainment, fuel and other necessities via certified applications that are filtered for application integrity and security.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

This invention may be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout. As used herein, the term "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As will be appreciated by one of skill in the art, portions of the invention may be embodied as a method, device, or computer program product. Accordingly, the present invention may take the form of an entirely hardware embodiment or an embodiment combining software and hardware aspects all generally referred to as a "circuit" or "module."

The present invention thus includes a computer program product which may be hosted on a computer-usable storage medium having computer-usable program code embodied in the medium and includes instructions which perform the processes set forth in the present specification. The storage medium can include, but is not limited to, any type of disk including floppy disks, optical disks, CD-ROMs, magneto-optical disks, ROMs, RAMs, EPROMs, EEPROMs, flash memory, magnetic or optical cards, or any type of media suitable for storing electronic instructions.

Computer program code for carrying out operations of the present invention may be written in any programming language including without limitation, object oriented programming languages such as Java®, Smalltalk, C# or C++, conventional procedural programming languages such as the "C" programming language, visually oriented programming environments such as VisualBasic, and the like.

Obviously, many other modifications and variations of the present invention are possible in light of the above teachings. The specific embodiments discussed herein are merely illustrative, and are not meant to limit the scope of the present invention in any manner. It is therefore to be understood that within the scope of the disclosed concept, the invention may be practiced otherwise then as specifically described.

The invention claimed is:

1. A computer program product embodied on a non-transitory computer readable medium configured to manage monitored traffic flow executed by a computer, the computer program product infrastructure comprising:

a plurality of remote devices arranged in a plurality of vehicles, wherein the remote devices are equipped with AVICS;

a plurality of remote communication devices;

wherein one or more of the plurality of remote communication devices comprise an RFIDGPS module registered on a network;

wherein one or more of the plurality of the remote communication devices can be stationary or mobile devices;

wherein the communication devices transmit and receive encrypted data;

wherein the remote communication devices includes traffic flow management directed towards specific vehicles or group or an entire areas network;

wherein one or more of the plurality of remote mobile communication devices comprise an RFIDGPS module integrated with cellular capabilities or other com links having a reserved IPv(set) for isolation integration including subsets for each municipality or city and utilizing a (Stationary Hub Identifier) SHID that has a dedicated IPv(set), that reflects the ESN or other unique cellular identifier assigned to each Avics within each Vector Hub, onboard vehicle processor or portable pAVics for communication devices registered on any network;

wherein each of the communication device is equipped with nuclex operating system which is locked and hard coded and uses token sets for security purposes;

wherein each communication device is configured to broadcast warnings or signals relating to speed reductions, route alterations and hazards;

each communication devices are configured to send traffic data transmissions through a secure cryptic VPN connection to each hub sensor device or other communication devices equipped with Avics;

wherein each communication device communicates via sub-navigations systems separated from each other on inputs to Xgenasys such that data feeds are compartmentalized for each type of communication device for security reasons;

Each of the communication devices is configured to track network packet traffic variables consisting of transmitted vehicular longitude and latitude geographic positional data, feedback to and from onboard vehicle processor broadcasting iVoiceCommands with or without visual displays, voice commands of speed variations and other traffic maneuvering suggestions based on network traffic congestions artifacts to or from one or more vehicles;

wherein data from traffic variables are computed based on driver inputs;

wherein driver inputs further consist of obstacles on road-ways, historical markers from on board vehicle processors used to calculate future road congestion maintenance and expansion concerns;

a central server;

a network interface in secure communication with the central server and the plurality of remote mobile communication devices registered over a network, the network interface being configured to send and receive and respond to transponder echo calls to make sure any mobile encrypted sensor communication device is offline from comparison relationship to present, traffic data through tVector Hubs utilizing encrypted data transfer utilizing Crypsis Tokenization;

wherein the traffic data includes historical geographical positional data on vehicular locational information calculating localization call points or route vectors from networks traffic congestion artifacts with directional flow constraints from speed alterations broadcasting traffic variables for a given network infrastructures area to specific or a group of vehicles;

data information consists of a networks fossil fuel consumption rate, maintenance information is pushed to tVector Hubs using an authenticated predefined data format and routinely checked for data integrity composition, mechanical information from onboard vehicle processors, emergency 911 access information, theft protection and other vehicle information such as advertisements or entertainment and other necessity options as a PDE for subscribers;

a first computer code for receiving traffic data from the plurality of remote communication devices strategically placed along roadway location and in secure communication with the plurality of the remote mobile devices, wherein all communication devices are equipped with AVICS;

a second computer code for updating traffic data in a shared database;

a third computer code periodically and continuously calculating an optimal traffic flow for one or more of vehicles traveling along one or more roadways based on the updated traffic data and computing traffic variables based on driver inputs; and a fourth computer code for transmitting timing adjustments over the network to one or more traffic light intersections based on the optimal traffic flow calculations and automatically presenting alternate routes, granular decelerate/accelerated speeds recommendations, accident updates, planned maintenance along with growth projections, congested routes or intersections; and the fourth computer code transmits timing adjustments over the network to one or more traffic light intersections based on the optimal traffic flow calculations using directional flow constraints from network traffic congestion artifacts rate flow;

a fifth computer code executing traffic data to one or more remote computers over the network to trucking and insurance carriers locational tracking and using traffic congestion lane variable for management decisions to close lanes for certain types of traffic for trucks, emergency responders and dignitaries, during peak movements, thereby maneuvering traffic packet rates based on flow rates in conjunction with topography and climatic expectations;

a sixth computer code calculating vehicle proximity from information transmitted by each vehicle to other surrounding vehicular traffic based on sensor data received from side, rear, and front sensors on the vehicle for avoiding collisions and sending the data to Xgenasys, transmitting encrypted data to surrounding vehicles and calculating preventative measures outputting advance warnings to surrounding vehicles to avoid collision;

a seventh computer code regulating data filtering certified applications such as advertisements and or entertainment subscribers for security purposes for data integrity composition inspections, prior to encrypted data transmissions sent to communication devices;

a eighth computer code for computing recommendations to dim or turn off street lighting circuits;

a ninth computer code, providing theft protection, wherein notifications are configured to send deactivation commands to on board vehicles processor or owner notifications via a mobile application; and safely deactivating vehicle when not moving and in safe area, with possible siren activation and GPS navigational location transmission to local authorities as a paid service event to subscribers.

2. The computer program product of claim 1, wherein the non-transitory computer program product further comprises a tenth computer code providing computing systems archiving encrypted vehicular traffic data to one or more remote computers over the network, executing comparative values received from onboard vehicle processors and or pAvics (portable advices) for insurance, state inspections status and vehicular licensing with DMV records, such data is shared with both state and federal DOT, along with other data such as traffic volume, vehicle types and more received from network communication devices to governmental agencies and dealers as a PSE (paid service event) for appropriate determination of service recommended advertisements.

3. The computer program product of claim 1, further comprising; a pAvics (portable version of Avics) integrated for mobile phones, smart phones, PDAs and GPS receiver devices;

the pAvics provides service for transmitting geographic positional data for cyclers, runners and motorcycles;

the pAvics also provides service for instant 911 service and trip analytics viewed over the internet as a paid service event; and wherein pAvics allows subscribers to send entertainment and other necessities, such that these applications are filtered for integrity and security.

* * * * *